United States Patent [19]

Evans et al.

[11] 4,145,634

[45] Mar. 20, 1979

[54] FLUORESCENT LAMP HAVING INTEGRAL MERCURY-VAPOR PRESSURE CONTROL MEANS

[75] Inventors: George S. Evans, Caldwell; Henry Skwirut, Verona, both of N.J.

[73] Assignee: Westinghouse Electric Corp., Pittsburgh, Pa.

[21] Appl. No.: 878,848

[22] Filed: Feb. 17, 1978

[51] Int. Cl.[2] ..... H01J 61/28; H01J 61/42

[52] U.S. Cl. ..... 313/490; 29/25.11; 313/174

[58] Field of Search ..... 313/490, 174; 29/25.11

[56] References Cited

U.S. PATENT DOCUMENTS

| | | | |
|---|---|---|---|
| 1,826,385 | 10/1931 | Beck | 313/174 |
| 2,280,618 | 4/1942 | Besson | 313/177 |
| 4,015,162 | 3/1977 | Evans et al. | 313/490 |
| 4,047,071 | 9/1977 | Busch et al. | 313/490 |

*Primary Examiner*—Palmer C. Demeo
*Attorney, Agent, or Firm*—D. S. Buleza

[57] ABSTRACT

The mercury-vapor pressure within an operating fluorescent lamp is regulated by several discrete bodies or bits of a suitable amalgamative metal (such as indium or an indium alloy) that are placed into the lamp envelope before it is sealed. The metal bodies are not secured to any of the structural parts of the lamp and are thus free to move about within the envelope. When they subsequently combine with the dosed mercury in the finished lamp, they form a plurality of mobile amalgam bodies that are distributed at random locations within the lamp and release controlled amounts of mercury vapor when the lamp is energized and the amalgam bodies are heated. The amalgamative metal is preferably dispensed into the envelope in the form of spherical pellets that are provided with a porous non-stick coating to prevent them from becoming accidentally attached to each other or to the lamp electrodes. The amalgamative metal pellets may also be combined with the mercury outside the lamp to form pellets of preformed amalgam which, when dispensed into the envelope, simultaneously doses the lamp with predetermined amounts of both mercury and amalgamative metal. The introduction of a measured amount of an amalgamative metal into the lamp, either separately or in combination with a predetermined dosage of mercury, can thus be achieved in a very simple and economical manner during the normal sequence of operations required to manufacture the lamp.

18 Claims, 4 Drawing Figures

FLUORESCENT LAMP HAVING INTEGRAL MERCURY-VAPOR PRESSURE CONTROL MEANS

CROSS-REFERENCE TO RELATED APPLICATIONS

The subject matter of this application is related to and constitutes an improvement over that disclosed and claimed in pending application Ser. No. 715,257 (now U.S Pat. No. 4,071,288 of George S. Evans and Henry Skwirut, the joint authors of the present invention, which application was filed Aug. 17, 1976 and is assigned to the assignees of the present application.

BACKGROUND OF THE INVENTION

1. Field of the Invention

This invention relates to the electric lamp art and has particular reference to an improved amalgam-containing low-pressure discharge device, such as a fluorescent lamp, and to a method of manufacturing such lamps in a very convenient and economical manner.

2. Description of the Prior Art

Low-pressure mercury-vapor discharge lamps which contain a suitable metal, such as indium or the like, that is attached to an interior part of the lamp and combines with the mercury dosed into the envelope to form a fixed source of amalgam which controls the pressure of the mercury vapor during lamp operation are well known in the art. A fluorescent lamp of this type having an amalgamative metal, such as cadmium, that is secured to the inner surface of the phosphor-coated envelope in the form of a film or powder is described in U.S. Pat. No. 3,007,071 issued Oct. 31, 1961 to A. Lompe et al. In other lamps of this type the amalgamative metal is secured to other lamp components, such as the lamp stems, in predetermined heat-receptive proximity to the electrodes. A fluorescent lamp having amalgamative metal strips which are held in place on the lamp stem by a wire-mesh collar assembly is disclosed in U.S. Pat. No. 3,619,697 issued Nov. 9, 1971 to G. S. Evans. An improved lamp of this type in which the amalgamative metal is divided into small pellets that are fused directly to the glass surface of the lamp stems at strategic fixed locations is disclosed in U.S. Pat. No. 4,020,378 issued Apr. 26, 1977 to C. Morehead.

In accordance with a more recent development in the evolution of amalgam-type fluorescent lamps, pellets of a suitable amalgamative metal such as indium are dropped into the envelope during the stem sealing-in operation while the envelope is positioned in such a manner that the metal pellets strike and automatically become fused and bonded to the hot glass seal which joins the stem to the lamp bulb. The implanted pellets are desirably coated with a porous layer of a suitable inert material to prevent the liquid mercury, which is subsequently dosed into the lamp, from striking and being absorbed by the implanted pellets and liquifying them to such a degree that they become detached from the glass seal. A fluorescent lamp having such amalgamative metal pellets implanted in the stem-envelope seal is disclosed in U.S. Pat. No. 4,015,162 issued Mar. 29, 1977 to G. S. Evans and H. Skwirut. The aforementioned cross-referenced related application of the same inventors discloses and claims the method of implanting such metal pellets in the lamp seal during lamp manufacture.

A neon-glow tube that contains an amalgam protectively disposed within a tubulation attached to the envelope (or in a perforated glass ball positioned within the envelope) at a location such that it releases a sufficient amount of mercury vapor or other gas to compensate for that which is lost by "clean-up" during operation of the device and thus preserves the critical gas mixture and low starting voltage characteristics of the device is disclosed in U.S. Pat. No. 2,280,618 issued Apr. 21, 1942 to R. Besson.

SUMMARY OF THE INVENTION

While the prior art amalgam-type fluorescent lamps were generally satisfactory from a functional standpoint, they required specially made components to prevent the amalgamative metal from being directly exposed to the discharge and required some means of keeping the amalgamative metal at a fixed location within the lamp where it would not come in contact with the lamp electrodes. These restrictions or requirements not only complicated the manufacture of the lamps on a mass-production basis but increased the lamp cost.

These disadvantages are overcome in accordance with the present invention by introducing the amalgamative metal into the lamp before the envelope is hermetically sealed and allowing the metal to move freely within the finished lamp and be exposed to the discharge. Contrary to the prior art teachings which indicated that the amalgamative metal had to be anchored at a strategic fixed location within the lamp envelope and shielded from direct exposure to the arc discharge, it was surprisingly discovered that satisfactory regulation of the mercury-vapor pressure during lamp operation could be achieved by using small bodies or bits of amalgamative metal that are free to move about within the lamp and provide amalgam bodies that are also mobile and thus distributed at randomly disposed locations within the envelope, even though some of them are exposed to the arc discharge.

In accordance with one embodiment of the invention, the amalgamative metal is formed into generally spherical pellets of uniform mass and size and a predetermined number of such pellets are simply dispensed into the lamp envelope through the exhaust tube just before the lamp is evacuated, charged with fill gas, dosed with mercury and the exhaust tube is hermetically sealed. The number of pellets dispensed into the lamp are correlated with the mercury dosage so that the total amount of amalgam subsequently formed within the finished lamp (when the mercury combines with the metal pellets) is sufficient to maintain the mercury vapor pressure within the proper range required for optimum light output. The amalgamative metal pellets, as well as the subsequently formed amalgam pellets, are mobile and become randomly distributed within the finished lamp at various locations along the lowermost part of the glass envelope, depending upon how the lamp is physically oriented. In order to prevent the pellets from becoming attached to the electrodes or to one another and thus interfering with the normal operation of the lamp or the vapor-pressure regulation, the amalgamative metal pellets are desirably provided with a coating of a suitable inert material that is porous to mercury vapor and prevents the pellets from sticking to one another or to interior components of the lamp, such as the electrodes.

According to an alternative embodiment, the pellets of amalgamative metal are combined with a predetermined amount of mercury outside the lamp to provide preformed amalgam pellets that are dispensed into the lamp envelope before its exhaust tube is sealed, thus dosing the lamp with measured amounts of both mercury and an amalgamative metal in one simple operation rather than two separate operations.

BRIEF DESCRIPTION OF THE DRAWINGS

A better understanding of the invention will be obtained from the exemplary embodiment shown in the accompanying drawing, in which.

DESCRIPTION OF THE PREFERRED EMBODIMENTS

While the invention can be advantageously employed in the manufacture of various kinds of electric discharge devices that contain a vaporizable metal (such as mercury) and require some means for regulating the metal-vapor pressure within the device when it is operated, it is particularly adapted for use in conjunction with low-pressure type electric discharge lamps such as fluorescent lamps and accordingly have been so illustrated and will be so described.

Figure 1:
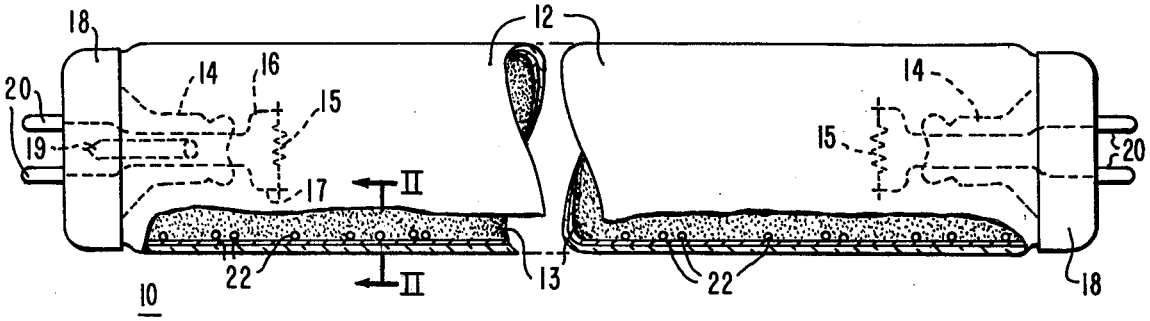
FIG. 1 is a side-elevational view of a fluorescent lamp embodying the invention, a portion of the envelope being removed to show the mobile pellets of amalgamative metal randomly distributed along the bottom of the horizontally disposed lamp envelope.

Such a lamp 10 is shown in FIG. 1 and comprises the usual elongated tubular envelope 12 of vitreous light-transmitting material that is provided with an inner coating 13 of suitable ultraviolet-responsive phosphor and contains an ionizable medium. The envelope 12 is closed at each end by vitreous stems 14 that are sealed to the envelope in the customary manner and support a pair of electrodes 15. One of the stems 14, as shown, is provided with an exhaust tubulation 19 that communicates with an opening in the stem wall and has its outer end hermetically tipped-off after the envelope 12 has been evacuated, charged with a suitable fill gas (such as argon or a mixture of neon and argon at a suitable pressure below 10 torr), and dosed with a measured amount of mercury in accordance with standard lamp-making practice.

The electrodes 15 comprise tungsten wire coils that are coated with well-known electron emissive material and are held in place within the lamp by pairs of attached lead wires 16, 17 which are sealed through the inner ends of the stems 14 and extend into suitable bases 18 that are cemented to and enclose the sealed ends of the envelope 12. The bases 18 are provided with suitable terminals, such as a pair of metal pins 20, that are electrically connected to the associated pair of lead wires 16, 17 in the usual manner.

Figure 2:
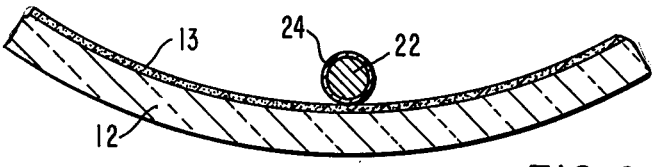
FIG. 2 is an enlarged fragmentary cross-sectional view through a portion of the lamp envelope and one of the metal pellets, along line II—II of FIG. 1.
Figure 3:
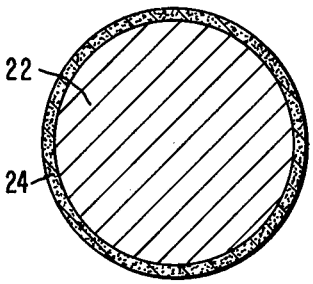
FIG. 3 is a cross-sectional view of one of the amalgamative metal pellets on a greatly enlarged scale.

In accordance with the present invention, the pressure of the mercury vapor within the fluorescent lamp 10 during operation is controlled by a measured quantity of a suitable amalgamative metal which is divided into a number of small bodies or bits, preferably pellets 22 of generally spherical configuration as shown in FIGS. 1–3. Suitable amalgamative metals are indium, gallium, gold, lead, tin, cadmium, zinc and alloys thereof. The metal pellets 22 are dispensed into the envelope 12 just before the tubulation 19 is tipped off—that is, long after the stems 14 have been sealed to the envelope 12 and immediately after the envelope is evacuated, charged with fill gas and dosed with liquid mercury. The pellets 22 are not fastened or secured to any interior component of the lamp 10 and are thus mobile and are free to move about within the envelope 12 and come to rest at various locations along the bottom of the envelope, depending upon how the lamp is oriented. As will be noted in FIGS. 1 and 2, when the lamp 10 is horizontally disposed (that is, in the position in which it will be normally burned and used) the metal pellets 22 will automatically be distributed at randomly spaced points along the curved bottom of the tubular envelope 12. Thus, some of the pellets 22 will be positioned in the imidiate vicinity of the electrodes 15 while others will be located near the center of the envelope 12 and at its sealed ends adjacent the stems 14. Of course, when the envelope 12 is oriented in a vertical or upstanding position, the pellets 22 will roll toward and collect at the lower end of the envelope.

In either case, the pellets 22 are exposed to the the lamp atmosphere and are accordingly able to combine with the liquid mercury that is dosed into the envelope 12 and thus form a plurality of amalgam bodies or pellets in the completed lamp 10. When thus amalgamated with the dosed mercury, the pellets 22 collectively function as a main source of amalgam which controls the mercury-vapor pressure within the finished fluorescent lamp 10 when it is energized and operated. The total amount of amalgamative metal in pellet form is so correlated with the dosed quantity of liquid mercury that the mercury-vapor pressure within the operating lamp is maintained within a range of approximately 6 to 10 microns.

In order to insure that the pellets 22 remain mobile and do not become accidentally attached to one of the electrodes 15 or to each other, they are preferably provided with a non-stick coating 24 of a suitable material that is porous to mercury vapor, chemically inert with respect to the ionizable medium and other interior lamp components, and which remains stable in the atmosphere and under the elevated temperatures to which it is exposed within the lamp 10 during operation. The coating material must also not be a source of contamination or have an excessively high vapor pressure. Suitable coating materials are powders of stable metal oxides (such as titania, zirconia, silica, magnesia, and alumina), graphite, powdered glass, phosphors of the type used in fluorescent lamps, borax, antimony oxide, powders of metals which do not readily form an amalgam with mercury (such as aluminum, iron and chromium), stable high-temperature type plastics such as teflon, and mixtures of such materials. Fumed silica powder (Silanox Grade 101 marketed by the Cabot Corp., Boston, Mass.) and hydrogen-fired aluminum flakes have been found particularly suitable. The aluminum flakes function as overlapping platelets on the surface of the amalgam pellets 22 which prevents them from directly contacting and sticking to undesired parts of the lamp structure or to other pellets.

The amalgamative metal bodies or pellets 22 can be coated en masse by shaking them vigorously in the powder, dust or flakes of the selected coating material.

Since amalgamative metal such as indium or indium-rich alloys are soft, the finely-divided coating material will abrade and inherently stick to the surface of the pellets 22 during this operation. The coating process will be facilitated if the pellets are heated sufficiently to be warm. Alternatively, the pellets can be "wetted" with a liquid suspension of the powder, flakes or dust and then dried. Coatings applied in this manner tend to be very thin but the coating thickness is not critical as long as the coating is porous and adherent.

In order to maintain precise control of the aggregate or total amount of amalgamative metal which is dispensed into the lamp 10, the pellets 22 are made of substantially uniform size and mass and are preferably generally spherical in shape, as illustrated in FIGS. 1–3. Each pellet 22 thus has a known mass and a predetermined number of pellets are simply placed into each envelope 12 to provide the required total amount of amalgamative metal necessary to form an amalgam of the proper composition when the measured amount of liquid mercury is also dosed into the envelope and subsequently combines with the metal pellets when the lamp is operated. However, care must be taken to avoid using pellets which are too large or which are too rich in mercury and thus very liquid or fluid at room temperature. If the pellets 22 are too large, they may also damage or dislodge pieces of the phosphor coating 13 when they are dispensed into the envelope 12. If they are too liquid at room temperature, the non-stick coating 24 may rupture and permit the pellets to join together and form one large unwanted mass or body of amalgam.

Satisfactory results have been obtained by using spherical pellets 22 of indium each having a mass below about 10 milligrams but now below 2 milligrams. The pellets are preferably from about 3 milligrams to 7 milligrams each. This was confirmed by comparative tests conducted on 40 watt fluorescent lamps approximately 122 centimeters long having envelopes 38 millimeters in diameter. One group of test lamps was dosed with 10 spherical pellets of indium weighing 5.45 milligrams each which were coated by vigorous shaking in fumed silica powder. Each lamp was dosed with 23.5 milligrams of liquid mercury and the 10 indium pellets absorbed the mercury to form 10 amalgam spheres that contained 80 atom percent indium and were hard at room temperature. A second test group of fluorescent lamps were made in a similar manner but were dosed with only five coated spherical pellets of indium of the same mass so that the resulting pellets of indium-mercury amalgam contained 68 atom percent indium and tended to be somewhat liquid at room temperature. However, the fumed silica coating successfully contained both amalgams and prevented the amalgam pellets from uniting with each other and becoming attached to internal lamp parts.

Figure 4:
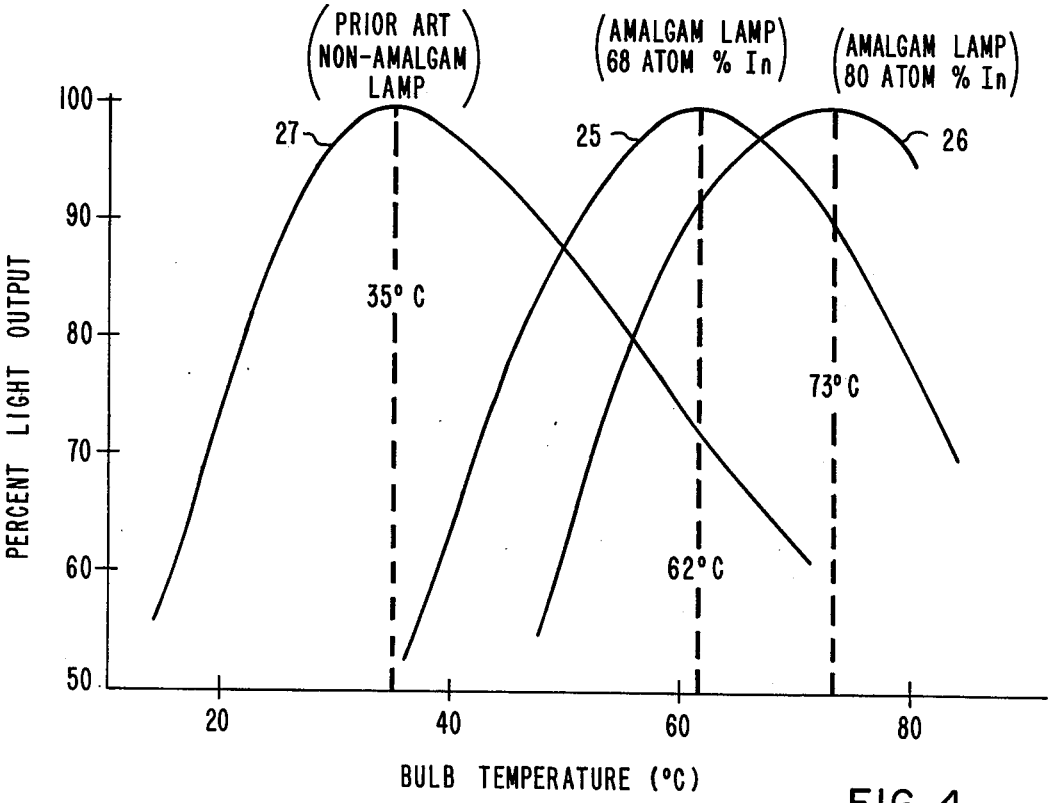
FIG. 4 is a graph comparing the light output versus bulb temperature characteristics of two different test lamps embodying the invention with that of a conventional lamp of the same type but containing no amalgam.

The above-described groups of test lamps were operated under controlled temperature conditions to determine whether the amalgam pellets properly controlled the mercury-vapor pressure. The variation of light output as a function of bulb temperature for each lamp was determined by operating the lamps in a water bath, the temperature of which was varied in a controlled manner. The lamps were burned in a horizontal position so that the amalgam pellets were positioned at random locations along the bottom portion of the bulb walls. The test results are graphically illustrated in FIG. 4. As will be noted, the lamps which contained the five amalgam pellets with 68 atom percent indium reached peak light output at a bulb wall temperature of approximately 62° C. (curve 25). This temperature is very close to the bulb wall temperature exhibited by 40 watt amalgam-type fluorescent lamps when operated in a four-lamp recessed troffer luminaire or lighting fixture. The lamps which contained the ten amalgam pellets with 80 atom percent indium reached peak light output at a bulb wall temperature of around 73° C. (curve 26). Such elevated bulb wall temperatures are not unusual and can be exhibited by lamps that are enclosed in a protective housing or "jacket" or are operated at very high power inputs and loadings. This particular amalgam composition and dosage would thus be appropriate for such lamp types.

In contrast, curve 27 depicts the light output versus bulb temperature characteristic of a conventional 40 watt lamp of the same size and rating as the test lamps but which did not contain an amalgam. As shown, such prior art lamps reach a peak light output at approximately 35° C. and achieve only about 72 percent of its peak light output at a bulb temperature of 62° C. and only about 60 percent (extrapolated) of its peak output at a bulb temperature of 73° C.

The invention is not limited to the use of amalgam pellets 22 that are mobile and of such composition that they are in a solid or semi-solid state at room temperature, or which have a mass below 10 milligrams each. For example, amalgam pellets which contain only 36 atom percent indium and are thus very liquid at room temperature can be employed if they are coated with or include a material that forms a matrix-like film or layer—that is, one which is cohesive and net-like with sufficient strength to prevent the amalgam pellet from rupturing when it moves. Such films or layers can be formed by coating the amalgamative metal with particles of low melting point glasses and sintering the particles when the lamp is being baked during the exhaust operation, or by using coating materials such as sodium silicate and the like which decompose when baked in a vacuum to produce a "lace-like" structure of interlocking needles or crystals. Alternatively, the amalgam composition can be varied to obtain the most effective amalgam-containment with different coatings. For example, an indium-lead alloy forms a stiffer or harder amalgam than does indium alone and pellets utilizing such an alloy exhibit less body deformation as they move about within the finished lamp. Powder-type coatings on such stiffer amalgam pellets thus remain intact and are more effective in preventing the pellets from becoming attached to one another or to undesirable structural parts of the lamp such as the electrodes.

Matrix-like films or layers are preferably used with indium pellet and mercury dosages which provide amalgams which contain from about 35 atom percent to about 68 atom percent indium and are thus liquid at room temperature. The previously described simple powder, dust or flake coatings are preferably used with amalgam pellets or bodies that contain from about 68 atom percent to about 95 atom percent indium and are thus in a solid or semi-solid state at room temperature. The preferred amalgam compositions for use with such simple powder, dust or flake-type coatings contain from about 72 atom percent to about 90 atom percent indium.

If desired, the separate mercury dosing operation can be eliminated by combining measured amounts of a selected amalgamative metal and liquid mercury outside the envelope to form a predetermined quantity of amalgam, dividing the amalgam and forming it into discrete bits or pellets of uniform mass and shape, and then coating the pellets and dispensing a predetermined number of them into the lamp before it is hermetically sealed. The amalgamative-metal dosing and mercury dosing operations would accordingly then be achieved simultaneously since precisely controlled quantities of both materials would be present in the preformed amalgam pellets placed into the lamp.

We claim as our invention:

1. In a mercury-vapor discharge lamp of a type which requires the presence of a predetermined quantity of mercury vapor during operation for optimum light output, the combination of;

a sealed light-transmitting envelope that contains spaced electrodes and an ionizable medium which includes mercury, and means in said envelope for providing said predetermined quantity of mercury vapor and regulating the mercury-vapor pressure within the lamp during the operation thereof comprising a plurality of discrete bodies of a metal that combines with the mercury within the lamp and forms an amalgam which releases mercury vapor when the lamp is energized and the amalgamative metal bodies are exposed to heat generated by the lamp, said bodies of amalgamative metal being (a) completely mobile and free to move about within the sealed envelope, (b) gravitationally distributed at random locations within said envelope, and (c) of such size that, when combined with the mercury, they form an amalgam of predetermined composition which releases said predetermined quantity of mercury vapor despite the random location of the amalgamative metal bodies.

2. The discharge lamp of claim 1 wherein said bodies of amalgamative metal are coated with a material that is porous to mercury vapor, chemically inert with respect to the ionizable medium and other internal components of the lamp, and provides the bodies of amalgamative metal with a non-stick surface which enhances the mobility of said bodies.

3. The discharge lamp of claim 2 wherein said mobile bodies of amalgamative metal are coated with a material from the group consisting of titania, zirconia, magnesia, silica, alumina, graphite, powdered glass, phosphor, aluminum, borax, antimony oxide, teflon and mixtures thereof.

4. The discharge lamp of claim 1 wherein;

said envelope contains a predetermined amount of mercury, and the number and size of the mobile bodies of amalgamative metal are such that said bodies, in the aggregate and when combined with said predetermined amount of mercury, form a quantity of amalgam sufficient to maintain the mercury-vapor pressure in the operating lamp within a selected range.

5. The discharge lamp of claim 1 wherein said ionizable medium comprises a measured dose of mercury and a fill gas at a pressure below about 10 torr and said lamp thus comprises a low-pressure discharge lamp.

6. The low-pressure discharge lamp of claim 5 wherein said envelope is of tubular elongated configuration, contains a pair of spaced electrodes, and has a phosphor coating on its inner surface and said lamp thus comprises a fluorescent lamp.

7. The fluorescent lamp of claim 6 wherein the number and mass of said mobile bodies of amalgamative metal are such that said bodies, in the aggregate and when combined with mercury within the envelope, form a quantity of amalgam sufficient to maintain the mercury-vapor pressure in the operating lamp within a selected range.

8. The fluorescent lamp of claim 7 wherein said mobile bodies of amalgamative metal are of pellet-like configuration and substantially uniform size.

9. The fluorescent lamp of claim 8 wherein said pellet-like amalgamative metal bodies are of substantially spherical shape and each have a mass less than about 10 milligrams.

10. The fluorescent lamp of claim 9 wherein;

the number and mass of said substantially spherical pellet-like bodies of amalgamative metal are such that the formed amalgam bodies are rich in mercury and are in a substantially liquid state when the lamp is not energized and the amalgam is at room temperature, and each of said amalgam bodies is coated with a matrix-like cohesive layer of a material that is chemically inert with respect to the interior lamp components and remains intact despite the movement of the amalgam bodies while in said substantially liquid state.

11. The fluorescent lamp of claim 10 wherein the amalgamative metal is indium and the formed amalgam bodies contain from about 35 atom percent to about 68 atom percent indium.

12. The fluorescent lamp of claim 10 wherein the mass of each of said mobile pellet-like bodies of amalgamative metal is from about 3 milligrams to about 7 milligrams.

13. The fluorescent lamp of claim 9 wherein;

the number and mass of said mobile pellet-like bodies of amalgamative metal are such that the formed amalgam bodies are rich in amalgamative metal and thus in a solid or semi-solid state when the lamp is not energized and the amalgam is at room temperature, and each of said mobile bodies of amalgamative metal is coated with a material that is porous to mercury vapor, chemically inert with respect to the interior lamp components, and provides the amalgamative metal bodies with a non-stick surface which prevents said bodies from becoming attached to the interior parts of the lamp and to each other.

14. The fluorescent lamp of claim 13 wherein said amalgamative metal is indium and the formed mobile bodies of amalgam contain from about 68 atom percent to about 95 atom percent indium.

15. The fluorescent lamp of claim 13 wherein;

the mass of each of said mobile bodies of amalgamative metal is from about 3 to 7 milligrams, the amalgamative metal is indium, and the formed amalgam bodies contain from about 72 atom percent to about 90 atom percent indium.

16. The fluorescent lamp of claim 13 wherein said amalgamative metal comprises an alloy of indium and lead.

17. In the manufacture of a mercury-vapor discharge device which has an hermetically sealed envelope, the method of dosing said device with a measured quantity of a mercury-amalgamative metal before the envelope is hermetically sealed, which method comprises;

dividing the measured quantity of amalgamative metal into a predetermined number of discrete bodies of selected size and shape, coating said amalgamative metal bodies with a material that is chemically inert with respect to the internal components of the finished device and provides the metal bodies with a non-stick surface, and introducing said coated amalgamative metal bodies into said envelope and, by virtue of their mobility, allowing them to become randomly distributed therein, and then completing the fabrication of said device.

18. The method of claim 17 wherein;

the measured quantity of amalgamative metal is first combined with a measured amount of mercury to form an amalgam of predetermined mass and composition, and said amalgam is divided into a plurality of smaller amalgam bodies which are subsequently coated with the non-stick material and introduced into the envelope so that the latter is thus simultaneously dosed with measured quantities of both mercury and amalgamative metal prior to being hermetically sealed.

* * * * *